United States Patent [19]

McCrory et al.

[11] 4,449,473

[45] May 22, 1984

[54] INFLATABLE BOAT WITH DEMOUNTABLE TRANSOM

[75] Inventors: William W. McCrory; William B. Quigley; William A. Garnett, all of Panama City, Fla.

[73] Assignee: The United States of America as represented by the Secretary of the Navy, Washington, D.C.

[21] Appl. No.: 437,708

[22] Filed: Oct. 29, 1982

[51] Int. Cl.[3] ..... B63C 9/04; B63B 7/08

[52] U.S. Cl. ..... 114/354; 114/345; 441/40

[58] Field of Search ..... 114/353, 354, 345; 441/40, 53

[56] References Cited

U.S. PATENT DOCUMENTS

| | | | |
|---|---|---|---|
| 2,545,084 | 3/1951 | Harasty | 114/354 |
| 2,949,616 | 8/1960 | Desanges | 9/2 |
| 2,966,687 | 1/1961 | Henry | 114/354 |
| 3,075,207 | 1/1963 | Lewis | 114/354 |
| 3,383,719 | 5/1968 | Van Der Heide | 9/2 |
| 3,453,671 | 7/1969 | Mambretti | 9/11 |
| 3,566,425 | 3/1971 | Welty | 9/2 |
| 3,694,836 | 10/1972 | Serra | 9/2 A |
| 3,810,268 | 5/1974 | Weihe | 9/2 R |
| 3,812,805 | 5/1974 | Forssell et al. | 114/61 |
| 4,231,131 | 11/1980 | Young | 9/2 C |
| 4,251,893 | 2/1981 | McCrory | 114/345 |
| 4,329,751 | 5/1982 | Cigognetti | 114/345 |

*Primary Examiner*—Trygve M. Blix
*Assistant Examiner*—Edwin L. Swinehart
*Attorney, Agent, or Firm*—Robert F. Beers; Harvey A. David

[57] ABSTRACT

An inflatable boat having parallel side sponsons joined by a floor and having a rigid keelson member includes a demountable transom capable of supporting an outboard motor. The transom is characterized by a motor mount pad connected to the keelson and having folding attachment arms connected to the sponsons.

8 Claims, 4 Drawing Figures

INFLATABLE BOAT WITH DEMOUNTABLE TRANSOM

This invention relates to high speed inflatable boats and more particularly to an improved transom construction therefor.

Prior art high speed inflatable boats powered by outboard motors require a transom that is capable of stably supporting the outboard motor in a predetermined position relative to the rest of the boat under conditions of thrust, torque, and the like. This requirement has been met in the boat described in U.S. Pat. No. 4,251,893 which includes a sectional tubular keelson and a rigid, wood transom that is bonded at its ends to the side sponsons and is engageable at its lower edge with the aft end of the tubular keelson. The transom therein described is, however, a limiting factor in the smallness that can be attained in packaging the boat when deflated and furled. In addition, that transom, as well as other similar outboard supporting transom constructions on other inflatable craft, is unduly heavy, subject to promoting fatigue and separation of fabric laminations where secured to the hull, and in short, is an area that can benefit by improvement.

SUMMARY OF THE INVENTION

With the foregoing in mind, it is a principal object of this invention to provide, in combination with an inflatable boat having inflatable side sponsons and a rigid fore and aft keelson, a demountable transom that is removably attached to the side sponsons and keelson and can itself be folded, to the end that the boat can be furled into a smaller package than heretofore, and yet provides the necessary rigidity of support for the sponsons and an outboard motor.

Another important object of the invention is the provision of an improved transom construction for inflatable boats, that offers the additional advantage of lightness in weight compared to the prior allwood transom, together with greater durability and a reliability under conditions of hard usage.

Still another object of the invention is to accomplish the foregoing through a novel combination of elements and arrangement of parts that offer ease and simplicity in assembly, maintenance, and repair, as well as convenience and interchangeability between boats.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
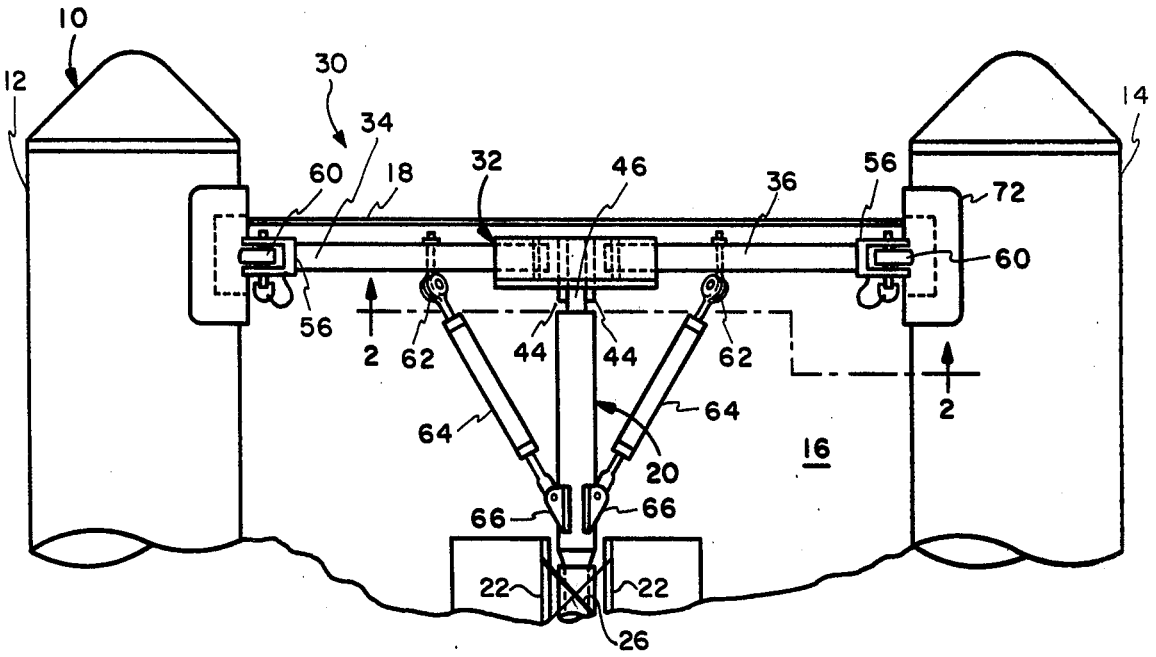
FIG. 1 is a plan view of the stern portion of an inflatable boat including a demountable transom embodying the invention.

In the exemplary form of the invention illustrated in the drawings and described hereinafter with reference first to FIG. 1, an inflatable boat 10 comprises parallel, laterally spaced inflatable side sponsons 12 and 14. A floor 16 spans the space between the sponsons and is advantageously of the inflatable construction described in U.S. Pat. No. 4,251,893. Rising from the aft edge of the floor 16, and fixed to the side sponsons 12 and 14 is a fabric transom wall 18. The wall 18 may be omitted in circumstances where it is desirable that water be allowed to freely run out the stern of the boat.

The boat is also provided with a fore-and-aft keelson 20, preferably of sectional, tubular construction and secured to the floor 16 by flaps 22 and lacing 24 in the manner described in the earlier mentioned patent. When assembled and in place in the inflated boat, the keelson 20 is rigid and serves to transmit motor thrust forwardly to the boat hull.

In accordance with the invention, the boat 10 comprises a demountable transom, generally indicated at 30, that spans the space between the side sponsons 12 and 14, and is removably attached thereto, as well as to the keelson 20. The transom 30, which serves as an outboard motor mount and provides rigidity to the stern portions of the boat, comprises a central, motor support pad 32 and a pair of laterally extending, transverse attachment arms 34 and 36 which, in the assembled condition of the transom, are axailly aligned with one another.

Figure 2:
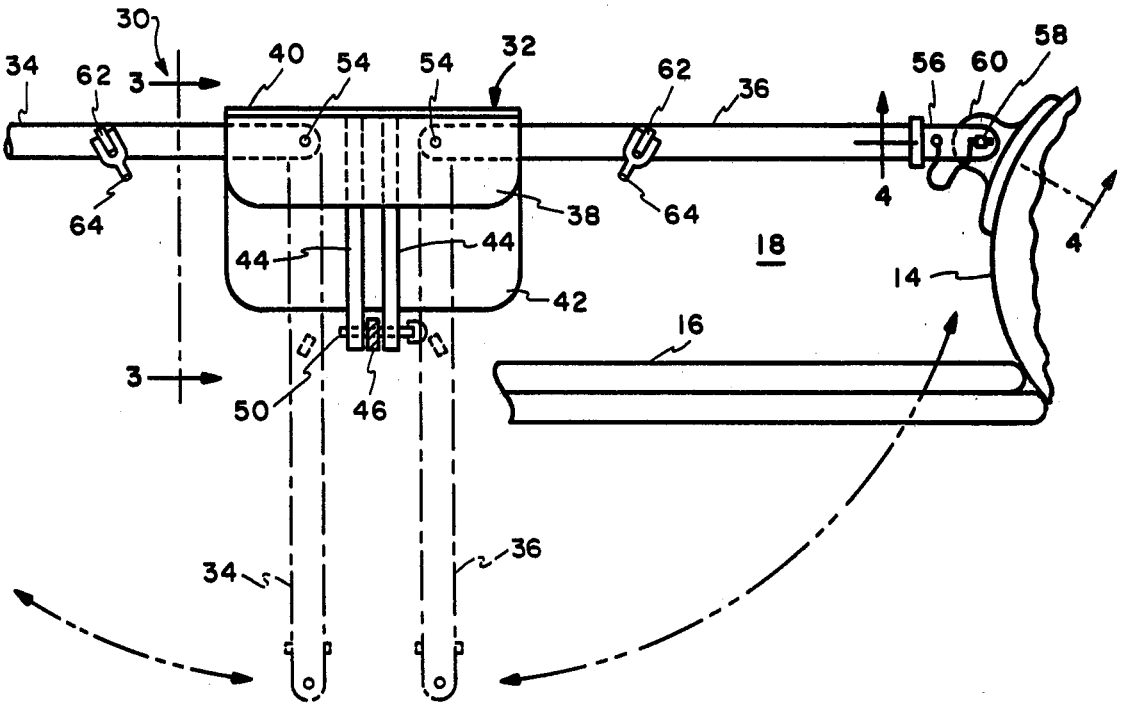
FIG. 2 is a fragmentary sectional view, on an enlarged scale, taken substantially along line 2—2 of FIG. 1.
Figure 3:
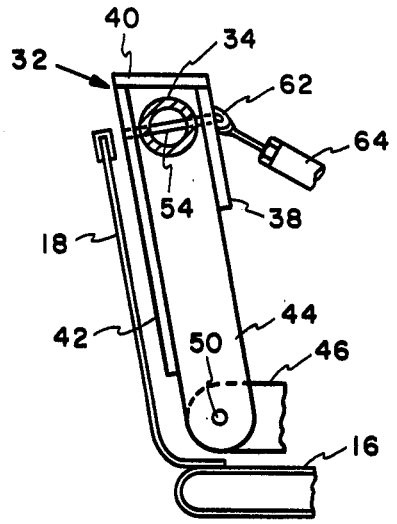
FIG. 3 is a fragmentary sectional view, on an enlarged scale, taken substantially along line 3—3 of FIG. 2.

As is best illustrated in FIGS. 2 and 3, the motor support pad 32 of this embodiment comprises a weldment of metal, e.g., aluminum, front, top, and rear walls or plates 38, 40, 42, respectively, assembled into a unitary, inverted channel shape which has vertical and lateral dimensions sufficient to receive an outboard motor clamp. The front wall 38 is in spaced parallel relation to the rear wall 42 and is conveniently of shorter vertical dimension than the rear wall. A pair of substantially vertical, parallel bars 44 are fixed, as by welding, in the space between the front and rear walls. The bars 44 are laterally spaced to receive between the bottom ends thereof an eye member 46 of the aft end of the keelson 20. Apertures in the bars 44 are aligned with the eye member 46 to receive a quick-release locking pin 50 for securing the transom and keelson together. The bars 44 further serve as rigidizing webs between the front and rear pad walls, and prevent crushing of the pad by outboard motor screw clamps.

The attachment arms 34, which are preferably tubular aluminum, have their inner ends extending into the channel space between the front and rear walls 38, 42 of the transom pad 32 and are pivotally connected therein as by pins 54. The outer end of each bar 34 is provided with a clevis 56 for removable attachment by a quick-release pin 58 to a pad-eye 60. The attachment arms 34 are further provided with eye-bolts 62, located at positions intermediate the ends of the bars, for connection by turnbuckles 64 to suitable eyes 66 on the keelson 20. The turnbuckles are disposed at angles to the keelson and the arms 34 and serve as braces that, because of the triangular relations between the keelson, transom, and turnbuckles, result in a particularly rigid structure.

Figure 4:
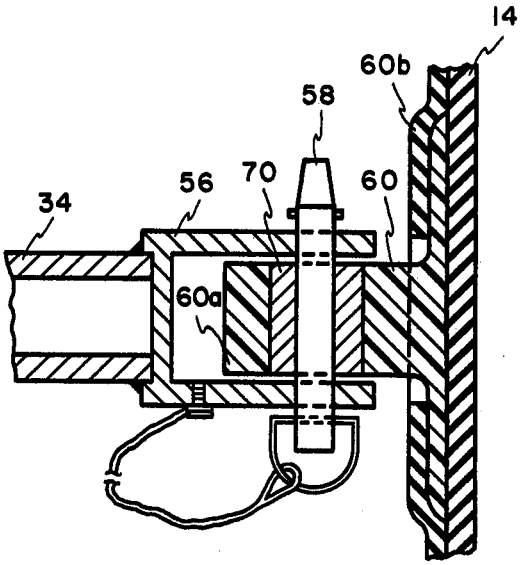
FIG. 4 is a fragmentary sectional view, on a still larger scale, taken substantially along line 4—4 of FIG. 3.

Referring to FIG. 4, the padeyes 60 are each shaped from a tough, resilient synthetic rubber and comprise an eye portion 60*a* and a pad or flange portion 60*b*. The eye portion is reinforced by a bushing 70 of bronze or other rigid, non-corrosive material bonded to the resilient pad-eye material.

The pad portion **60*b* is suitably cemented or bonded to the respective sponson 12 or 14 and further secured by a lamination of fabric 72** cemented thereover.

When the transom 30 is assembled with the boat, it is preferably disposed at a slight angle from the vertical, as shown in FIG. 3, and just inside and adjacent to the fabric transom wall 18. The wall 18 is conveniently clamped against the pad rear wall 42 by the clamp structure of an outboard motor, when installed.

In stored or furled condition, the transom 30 is separated from the connections at pad-eyes 60, turnbuckles 62, and the eye 46 of keelson 20. The arms 34 are pivoted to the dot-and-dash line positions of FIG. 2 to reduce the largest dimension of the transom. During assembly, it is only necessary to swing the arms 34 outwardly, attach them by pins 58 to the pad-eyes 60, attach the turnbuckles 64 to the eyes 62 by suitable pins and attach the bars 44 to the keelson eye 46.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. In combination with an inflatable boat having spaced, parallel side sponsons joined by a transverse floor, and a rigid keelson, a demountable transom for supporting an outboard motor, said transom comprising:

a pad structure comprising spaced front and rear walls, web means interconnecting said walls, and means for connecting said pad structure to the aft end of said keelson;

first and second attachment arms each having an inner end pivotally connected to said pad structure for movement between folded, side-by-side positions and opened, axially aligned end-to-end positions, said arms having first connecting means at their outer ends for releasable connection to cooperating second connecting means on said side sponsons; and brace means for connecting intermediate portions of said arms to said keelson.

2. The combination defined in claim 1, and wherein:

said pivoted inner ends of said arms are confined between said front and rear walls of said pad structure for movement in a common plane between said folded and open positions.

3. The combination defined in claim 2, and wherein:

said first connecting means each comprise a clevis and clevis pin and said second connecting means each comprise a padeye affixed to a sponson.

4. The combination defined in claim 3, and wherein:

each said padeye comprises an eye portion and a pad portion formed of a resiliently flexible material, and a rigid bushing element bonded in said eye portion.

5. The combination defined in claim 4, and wherein:

said front and rear walls of said pad structure comprise parallel rigid plates, said web means comprises a pair of substantially vertical, parallel spaced bars welded between said plates, and said bars extending below at least one of said plates to define an attachment for securement to said aft end of said keelson.

6. The combination defined in claim 5, and wherein:

said boat comprises a flexible fabric stern wall connected to said sponsons and to the aft edge of said floor; and said demountable transom is disposed adjacent to and in front of said fabric stern wall whereby said fabric stern wall is adapted to be clamped to said rear wall of said pad structure when an outboard motor is mounted thereon.

7. An inflatable boat that can be furled into a small package, said boat comprising:

first and second, generally cylindrical inflatable side sponsons having aft end portions in laterally spaced parallel relation;

a tubular keelson removably fixed to said floor structure and having fore and aft ends;

a fabric stern wall connected to the aft end of said floor structure and to said side sponsons; and a demountable transom disposed adjacent to the forward side of said stern wall and comprising an outboard motor mounting pad having front rear and top walls defining an inverted channel, web means fixed in said channel for supporting said walls against deformation, means releasably securing said motor mounting pad to said keelson aft end, first and second axially aligned attachment arms having inner ends received in said channel and outer ends releasably secured to said first and second side sponsons, and brace means connecting intermediate portions, said attachment arms being movable into parallel adjacent positions when said boat is furled.

8. A boat as defined in claim 7, and wherein:

said attachment arms are pivotally connected at said inner ends to said motor mount pad for swinging movement in a common plane between axially aligned and parallel adjacent positions.

* * * * *